United States Patent [19]

Huiskes

[11] 3,992,982

[45] Nov. 23, 1976

[54] FOLDING APPARATUS FOR CORRUGATED PAPERBOARD BLANKS

[75] Inventor: Martinus C. Huiskes, Almelo, Netherlands

[73] Assignee: Koppers Company, Inc., Pittsburgh, Pa.

[22] Filed: Feb. 11, 1975

[21] Appl. No.: 548,967

[30] Foreign Application Priority Data

Feb. 13, 1974 Netherlands ..... 7401947

[52] U.S. Cl. ..... 93/52; 93/49 R

[51] Int. Cl.[2] ..... B31B 1/38

[58] Field of Search ..... 93/52, 49 R, 49 M, 45, 93/48, 36 SQ, 36 R

[56] References Cited

UNITED STATES PATENTS

| | | | |
|---|---|---|---|
| 3,564,981 | 2/1971 | Von Arland et al. | 93/52 X |
| 3,572,221 | 3/1971 | Baum | 93/52 |
| 3,656,416 | 4/1972 | Baum | 93/52 |
| 3,797,370 | 3/1974 | Sawada | 93/52 X |
| 3,797,371 | 3/1974 | Randle | 93/52 |

*Primary Examiner*—James F. Coan

*Attorney, Agent, or Firm*—Oscar B. Brumback

[57] ABSTRACT

Apparatus for folding and sealing corrugated paperboard blanks having scores and slots therein comprising a blank feeding means, a conveying means to move the blanks including top and/or bottom folding means, such bottom folding means extending along the full length of the folding apparatus, such top folding means extending over the upstream portion of the folding apparatus, guide means for laterally guiding the panels to be folded, and an alignment means at the outlet end of the apparatus to align the folded panels.

10 Claims, 13 Drawing Figures

1
2
3
4
5
6
7
8
9
10
12
13
14
23
27
29
30
III
IV
V
VI
VII
VIII

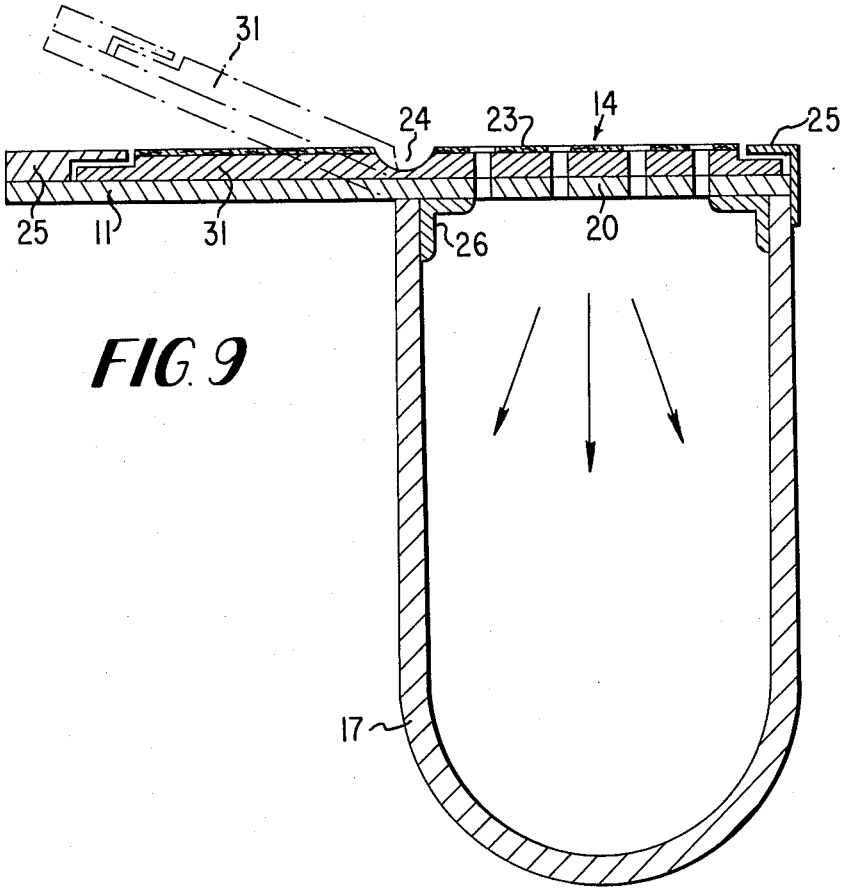
FIG. 9
FIG. 10
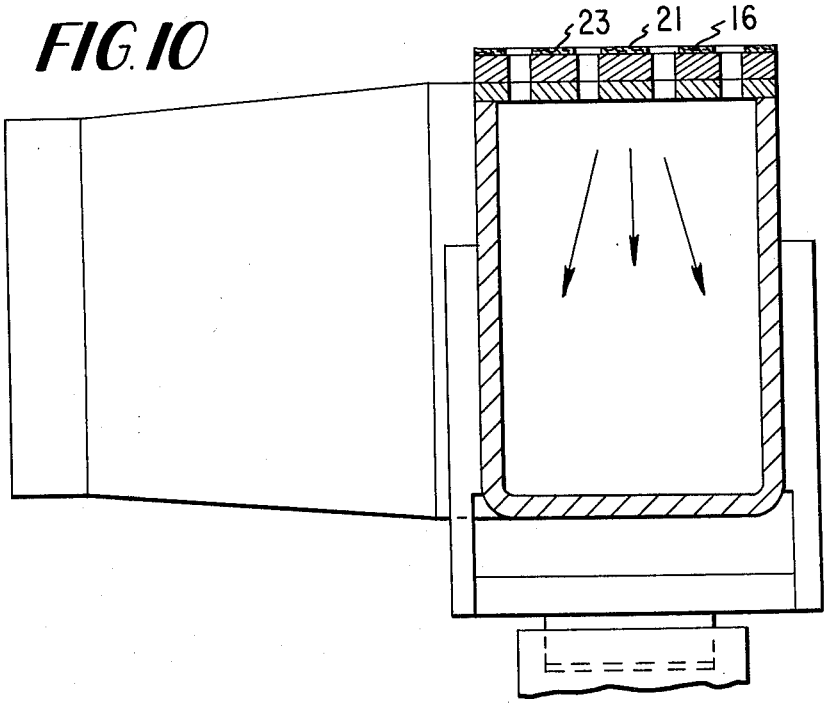

FIG. 11
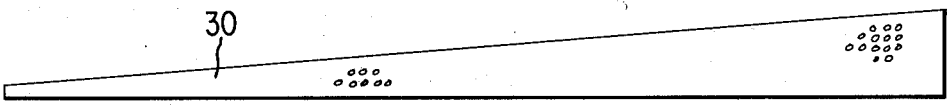
FIG. 12
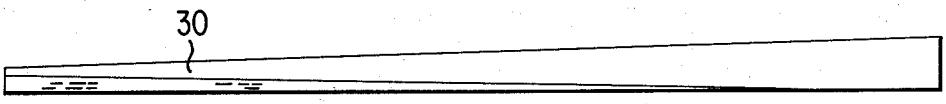
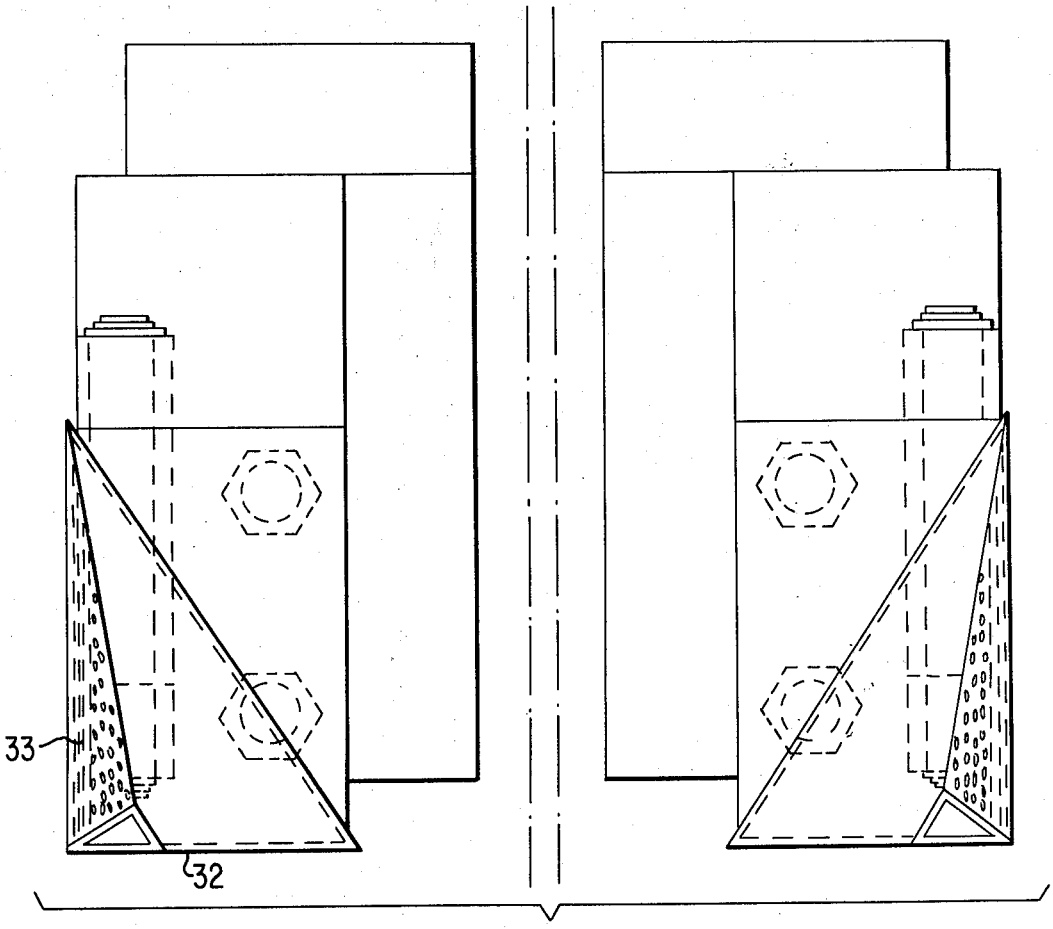
FIG. 13

FOLDING APPARATUS FOR CORRUGATED PAPERBOARD BLANKS

BACKGROUND OF THE INVENTION

1. Field of the Invention

This invention relates generally to paper manufactures and more specifically to box machines for folding paperboard blanks.

2. Description of the Prior Art

Folding and sealing apparatus is generally known in the corrugated paperboard industry, such machines being known as folder-gluers. These machines usually fold advancing blanks by means of moving belts or rotating rods or levers. Although many patents exist that show such machines, Lopez U.S. Pat. No. 3,122,069 is considered exemplary of the belt type and Spiess U.S. Pat. No. 3,240,185 is considered exemplary of the rod type.

In known folder-gluers, corrugated paperboard blanks, having folding or score lines and slots therein forming the dimensions of an erected carton, are advanced through the machine which folds the outermost panels defined by the score lines into overlapping relationship. Glue is applied along the outer edge of one panel so that it becomes bonded to an outer edge of the other panel thereby forming a flat tubular carton. Stacks of such blanks are shipped to the customer who then erects them, either manually or by machine, fills them with his goods, seals them and then ships the goods to the consumer.

The blanks, prior to folding, may be fed directly into the folder-gluer by a special feeding unit or the blanks may be fed directly from a printer-slotter machine which prints, scores, and slots the blanks. The folding elements of the folder, whether of the belt or rod type, are positioned across the width of the blank, that is, transverse to the direction of blank travel, so as to be substantially aligned with the score lines about which the blanks are to be folded.

Certain difficulties arise in the use of known folding apparatus such as the folded panels not being folded squarely with the non-folded panels. Another difficulty is that blanks having relatively large panel portions and long slots in the blanks often tear in the directon of the slots during the folding operation. This often occurs in blanks of low quality and is produced mainly by friction and bending forces along the grooves.

SUMMARY OF THE INVENTION

Accordingly, an object of the present invention is to overcome the foregoing and other problems and disadvantages. This is generally accomplished by a folding apparatus including a bottom folding means formed by a conveyor means having at least three parallel, horizontally spaced endless conveyor belts, each being supported over its length by a tubular support means, in which there is subatmospheric pressure, the top of said support means comprising a fixed, perforated cover plate across which the conveyor belt associated with it is movable with the portion of the conveyor belt engaging the support means being perforated; each of the two outermost conveyor belts having a perforated longitudinal portion maintained horizontal and having a non-perforated longitudinal outer portion that is bendable along the longitudinal axis of the conveyor belt with respect to the perforated portion.

Such apparatus reduces the frictional and bending forces on the blanks so that the machine may be operated continuously at high speed to produce precisely folded box blanks.

The foregoing and other objects and novel features will appear more fully from the following specification when read in connection with the accompanying drawings. However, it is to be expressly understood that the drawings do not define the invention but are for illustration only.

BRIEF DESCRIPTION OF THE DRAWINGS

In the drawings wherein like parts are marked alike:

FIG. 9 is a cross-sectional view of an outer blank support means in a longitudinal section of the folding apparatus;

FIG. 10 is a cross-sectional view of the center blank support means in a longitudinal section of the folding apparatus;

FIGS. 11 and 12 are side and top views respectively of a portion of the apparatus arrangement on the outlet of the top folding means; and FIG. 13 shows a front view of the outlet of the top folding means looking toward the direction of movement of blanks through the folding apparatus.

DESCRIPTION OF THE PREFERRED EMBODIMENT

Figures 1, 2:
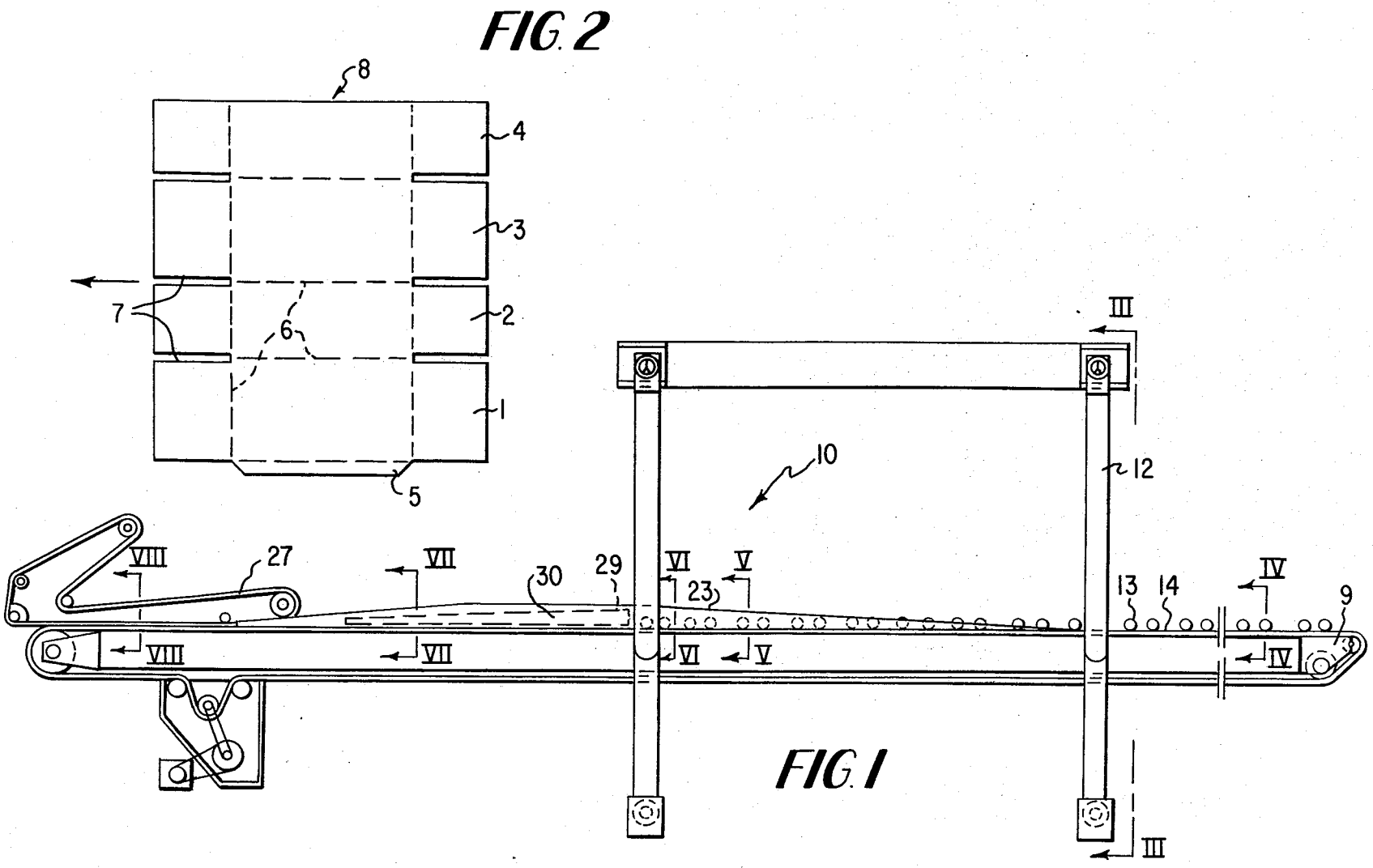
FIG. 1 is a schematic illustration in side elevation of the folding apparatus of the present invention.
FIG. 2 is a top view of a corrugated paperboard blank showing the scores and slots along which the blank is folded by the apparatus of FIG. 1.

A corrugated paperboard blank such as shown in FIG. 2 is fed by conventional feeding apparatus (not shown) into inlet 9 of the folding apparatus generally denoted as numeral 10 in FIG. 1. The blank includes panels 1–4 defined by longitudinally aligned scores 6 and slots 7; the blank is folded flat about the outermost score lines and slots and against the two inner panels during advancement through the folding apparatus 10. A glue tab 5 along the outer edge of the blank receives a coating of glue thereon prior to folding so that when it rests against the edge of the opposite outer panel, it is joined thereto after the glue has dried.

Figure 3:
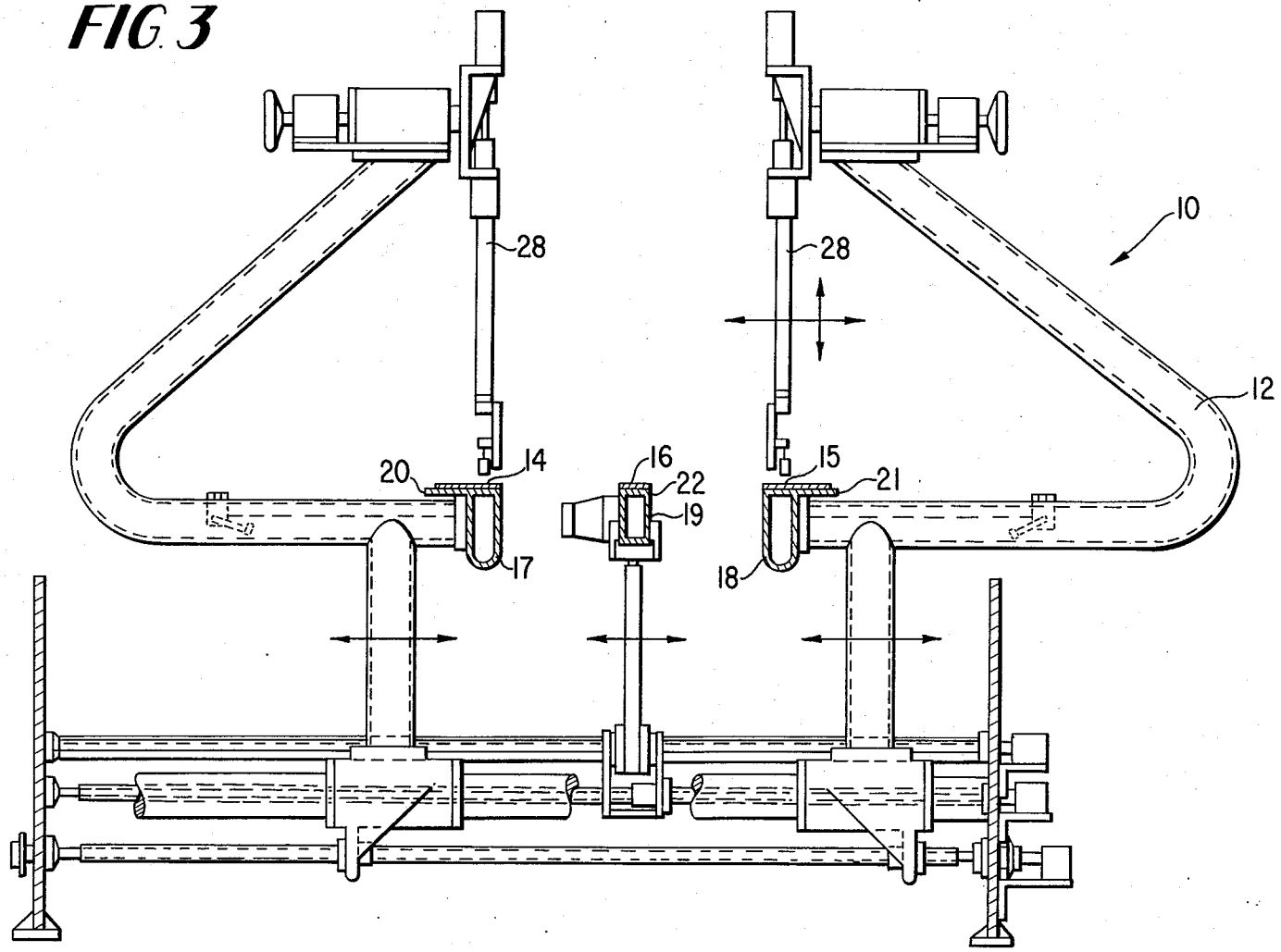
FIG. 3 is a cross-section of the folding apparatus of FIG. 1 taken along the line III—III.

The apparatus of FIG. 1 includes three parallel endless conveyor belts 14, 15 and 16 in the same horizontal plane but laterally spaced as shown in FIG. 3. Belts 14 and 15 are located along the longitudinal sides of the apparatus 10; the third conveyor belt 16 is located between belts 14 and 15.

The conveyor belts move continuously in synchronism and are supported for lateral adjustment in a frame 12 as shown in FIGS. 1 and 3. A blank fed onto the inlet 9 of folder 10 on top of the conveyor belts moves in compression between the bottommost folding means, that is, on top of the belts, and between a number of rollers 13 held in top folding means 28 (FIGS. 4–6) and onward through the apparatus.

The conveyor belts 14, 15 and 16 are each supported by a tubular support means shown schematically in FIGS. 4–8 and in greater detail in FIGS. 9 and 10. The two outer belts 14 and 15 are supported on support means 17 and 18 respectively and the center belt 16 is supported on center support means 19 as best illustrated in FIG. 3. Preferably, the center belt 16 is about half the width of the outer belts 14 and 15. Subatmospheric pressure, i.e. vacuum, is applied in the conventional manner to the interior of tubular supports 17, 18 and 19 each of which is covered on its top by a perforated plate so that negative air pressure is applied to beneath the belts. The supports 17, 18 and 19 are mounted for lateral adjustment along with their associated belts. The lateral extensions 11 of plates 20 and 21 beyond the sides of the outer tubular supports 17 and 18 are not perforated.

The conveyor belts 14, 15, and 16 are themselves perforated over the perforated area of the perforated plates so that negative air pressure from the supports 17, 18 and 19 is applied through the belts to beneath the advancing blanks which holds them firmly against the belts. Engagement of the blanks on the belts is enhanced by making the top surface of the belts from polyurethane plastic or other material having a high coefficient of friction.

Each of the lateral projections 11 of cover plates 20 and 21 on the outer tubular supports 17 and 18 is arranged horizontally at the inlet 9 of folder 10; but, it becomes gradually inclined upwardly, i.e., twisted, from the inlet toward the downstream direction of travel of the blanks, as illustrated by the dotted lines in FIG. 9, to its maximum twist at about numeral 30 in FIG. 1. The projections 11 are inclined an amount necessary to provide about two-thirds of the total amount of folding of the blanks, the maximum amount of twist being indicated in FIG. 7. However, the perforated portions of the plates 20 and 21 remain horizontal along their entire length beneath the conveyor belts.

Figure 4:
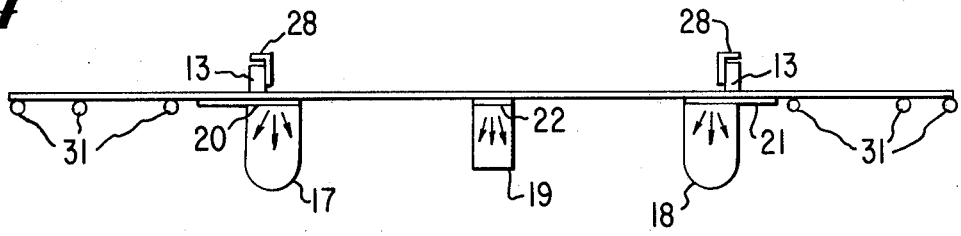
FIGS. 4 through 8 are schematic illustrations in cross-section of the apparatus of FIG. 1 taken along the lines IV through VIII respectively showing progressive folding of the blank of FIG. 2 as it advances through the machine.
Figure 5:
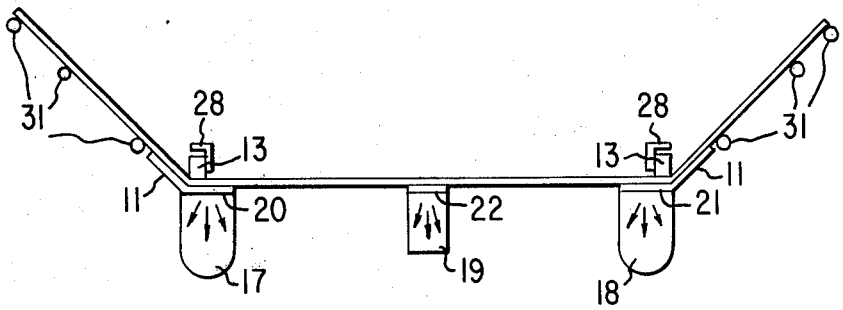
Figure 6:
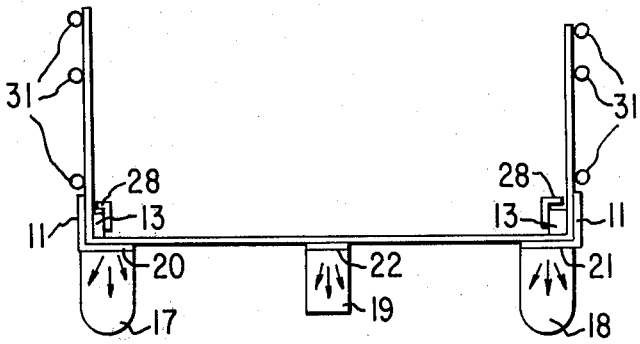

Hollow perforated tubes 31 are supported by conventional means (not shown) outwardly from projections 11 and in horizontal alignment therewith at the inlet 9, thereafter following the path of twist of projections 11 until they reach a vertical position as shown in FIGS. 4–6. These tubes guide the outer flaps or panels of the blanks during the folding process and air pressure provided therein by conventional means (not shown) blows against the panels so that they glide more or less frictionless against the tubes.

The outer belts 14 and 15 are made with a slot 24 therein (FIG. 9) extending around the periphery of the belts. This permits the outer portions of the belts to bend so as to follow the path of twist of projections 11 and therefore frictionally engage the outer panels of the blanks being folded, such outer portions of the belts not being perforated or in communication with the vacuum in supports 17 and 18. Projections 11 include guides 25 which overlap the edges of the belts and keep them in contact with projections 11. The cover plates may be secured to supports 17 and 18 by angular supports 26, also shown in FIG. 9.

Figure 7:
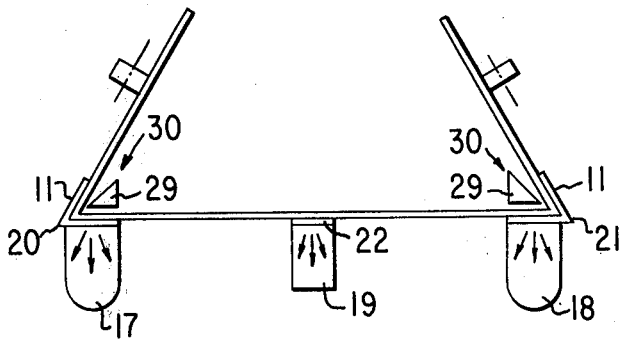

At about numeral 30, as indicated in FIGS. 1 and 7, the projections 11 are terminated; slightly upstream, as indicated by 29, a folding stave 30 begins (see FIG. 7) against which the outer panels of the blanks are pressed on the opposite side thereof from the folded outer portions of belts 14 and 15 as illustrated. The belts 14 and 15 gradually return to horizontal from the terminal end of projections 11. The blanks are pressed against the staves 30, whose inclined surface gradually tapers toward horizontal, until the almost completely folded blank passes beneath a number of conventional narrow belts 27 (FIG. 7), above the conveyor belts 14, 15 and 16, which complete the folding operation (FIG. 8) and discharge the blanks from folder 10.

During the first folding phase occurring between the positions shown in FIGS. 4–6, the vacuum or suction pressure is not alone sufficient to keep the panels 2 and 3 of blank (FIG. 2) tightly against the belts 14 and 15. The top folding means 28 (FIGS. 3, 4–6), including horizontally extending rails along the lower portion thereof as illustrated, exert pressure on the top of the panels through a series of rolls 13 mounted thereon. This pressure together with the suction pressure maintains the center panels 2 and 3 tightly against the belts despite the folding forces being exerted on the outer panels 1 and 4. The rails of folding means 28 are laterally adjustable therewith, as are the support means 17 and 18, to accommodate runs of blanks of different dimensions between the scores 6 setting the outer boundaries of inner panels 2 and 3. The top folding means 28 also include conventional pneumatic means for lifting the rails above the blanks in the event of a jam-up during the folding operation to permit rapid removal of damaged blanks.

The top folding means 28 would prevent further folding of the blanks from the position shown in FIG. 6 to the position of FIG. 7 if they extended beyond the stage of folding shown in FIG. 6. Therefore, the rails terminate at the point that outer panels 1 and 4 reach a vertical position, at about the beginning of stave 30 (FIG. 1) as indicated by a plane 29.

The stave 30 is suspended from folding means 28 so as to extend downstream therefrom. At the beginning of stave 30, the belts 14 and 15 are about 120° from their initial horizontal position. The stave 30 is triangular in cross-section as illustrated and tapers gradually downward from its beginning and downstream in the direction of blank travel as shown in FIG. 13. The sides of the hollow staves 30 adjacent the panels of the blanks are perforated, as shown in FIGS. 11 and 12, and compressed air therein (supplied by conventional means) permits the panels to be pressed against the sides without substantial friction.

Figure 8:
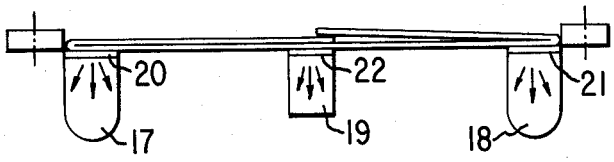

As the folded blanks pass beneath the belts 27, the folded edges thereof are engaged by the guide bars shown along the outer sides of FIG. 8. These bars may be adjusted laterally by conventional means (not shown) to exert a lateral pressure on the folded edges to align the panels 1 and 4 as well understood by those skilled in the art.

Thus, it can be seen that the suction pressure applied to the inner panels 2 and 3 from the bottom folding means 17, 18, and 19 maintain the blank in firm alignment during its progress through folder 10. However, the air pressure applied to the panels 1 and 4 by tubes 31 and to all the panels by staves 30 permit the blanks to glide effortlessly through the folder despite the considerable forces applied during the various folding stages. Thus, squarely folded blanks are produced without tearing. The folding means 28, including rollers 13, and the staves 30, as well as the aligning bars of FIG. 8, all contribute to the squareness of the folded box, shifting of the blanks from these members being prevented by the suction pressure.

As previously mentioned, the lower folding means 17 and 18 and upper folding means 28 are laterally adjustable to accommodate various widths of blanks. Lower folding means 19 may be similarly adjustable. The means for accomplishing lateral adjustment is conventional and may include a number of laterally extending support shafts and motor-driven threaded rods extending through the folding means such as illustrated in FIG. 3 as will be well understood by those skilled in the art.

Likewise, a conventional glue applying apparatus (not shown) is provided for applying a film of glue on tab 5 of the blanks. Such apparatus is preferably mounted on one of the folding means 28 so as to be laterally positionable therewith, also as well understood by those skilled in the art. Suitable lateral adjustment means and glue applying apparatus are shown in the aforementioned references and may be easily modified for use in the present invention.

Thus, the invention having been described in its best embodiment and mode of operation, that which is desired to be claimed by Letters Patent is:

1. Apparatus for folding and sealing paperboard blanks having scores and slots therein forming side panels on said blanks, comprising:

feeding means for feeding said blanks sequentially into said apparatus;

conveying means for advancing said blanks through said apparatus having a bottom folding means extending substantially the entire length of said apparatus and a top folding means extending along an upstream portion of said apparatus over said bottom folding means;

guiding means for laterally guiding said side panels of the blanks to be folded during advancement of said blanks through said apparatus between said top and bottom folding means; and an alignment means at the outlet end of said apparatus for aligning the folded side panels on said blanks, said bottom folding means including:

at least three parallel, horizontally aligned and laterally spaced conveyor belts each supported along its length by tubular support means having subatmospheric pressure therein, said tubular support means including perforated top portions across which perforated portions of said belts associated therewith are movable for directing said subatmospheric pressure to beneath portions of said blanks on top of said belts for firmly adhering said blanks to said belts during advancement of said blanks through said apparatus;

each of the outermost two of said belts including a longitudinally extending perforated portion maintained horizontally over said perforated top portions and a longitudinally extending non-perforated portion bendable around a longitudinal axis of said belts with respect to said perforated portions for guiding said side panels toward folding relationship with the remainder of said blanks.

2. The apparatus of claim 1 wherein:

said top folding means includes rollers exerting pressure downwardly against the top surfaces of said blanks along the upstream end of said apparatus and a pair of laterally spaced folding staves extending downstream from said rollers about which said side panels are folded.

3. The apparatus of claim 1 wherein:

each of said perforated top portions of the outermost ones of said tubular support means includes laterally outwardly extending, non-perforated projections for supporting said non-perforated portions of said conveyor belts associated therewith.

4. The apparatus of claim 1 wherein:

the outermost ones of said conveyor belts include longitudinally extending perforated inner portions that move horizontally along the length of said apparatus and longitudinally extending, non-perforated outer portions that move horizontally at an input end of said apparatus, that move gradually from horizontal movement to at least vertical movement along a center portion of said apparatus, and that move gradually from at least vertical movement to horizontal movement at an output end of said apparatus.

5. The apparatus of claim 4 further including:

tubular guide means laterally beyond said outermost conveyor belts extending longitudinally from said input end of said center portion of said apparatus and substantially following the path of movement of said outermost conveyor belts for folding said outer panels upward and inwardly toward the center panels of said blanks, said tubular guide means having compressed air therein directed against said side panels through perforations in said tubular guide means for reducing friction between said tubular guide means and said side panels during advancement of said blanks past said tubular guide means.

6. Apparatus for folding and sealing paperboard blanks having scores and slots therein forming side panels on said blanks, comprising:

feeding means for feeding said blanks sequentially into said apparatus;

conveying means for advancing said blanks through said apparatus having a bottom folding means extending substantially the entire length of said apparatus and a top folding means extending along an upstream portion of said apparatus over said bottom folding means;

guiding means for laterally guiding said side panels of the blanks to be folded during advancement of said blanks through said apparatus between said top and bottom folding means; and an alignment means at the outlet end of said apparatus for aligning the folded side panels on said blanks, said bottom folding means including:

at least three parallel, horizontally aligned and laterally spaced conveyor belts each supported along its length by tubular support means having subatmospheric pressure therein, said tubular support means including perforated top portions across which perforated portions of said belts associated therewith are movable for directing said subatmospheric pressure to beneath portions of said blanks on top of said belts for firmly adhering said blanks to said belts during advancement of said blanks through said apparatus, each of the outermost two of said belts including a longitudinally extending perforated portion maintained horizontally over said perforated top portions and a longitudinally extending non-perforated portion bendable around a longitudinal axis of said belts with respect to said perforated portions for guiding said side panels toward folding relationship with the remainder of said blanks, each of said perforated top portions of the outermost ones of said tubular support means including laterally outwardly extending, non-perforated projections for supporting said non-perforated portions of said conveyor belts associated therewith, each of the outermost ones of said conveyor belts including a longitudinally extending groove formed in the top surface thereof separating the perforated and non-perforated portions of said belts.

7. The apparatus of claim 4 further including:

belt guide means on said outwardly extending projections of said top portions for laterally guiding said conveyor belts associated therewith.

8. The apparatus of claim 7 wherein:

the width of said outermost ones of said conveyor belts is substantially twice the width of the third conveyor belt between said outermost belts.

9. The apparatus of claim 8 wherein:

each of said conveyor belts includes a top surface of high friction material for frictionally engaging the under surfaces of said blanks thereon.

10. Apparatus for folding and sealing paperboard blanks having scores and slots therein forming side panels on said blanks, comprising:

feeding means for feeding said blanks sequentially into said apparatus:

conveying means for advancing said blanks through said apparatus having a bottom folding means extending substantially the entire length of said apparatus and a top folding means extending along an upstream portion of said apparatus over said bottom folding means;

guiding means for laterally guiding said side panels of the blanks to be folded during advancement of said blanks through said apparatus between said top and bottom folding means; and an alignment means at the outlet end of said apparatus for aligning the folded side panels of said blanks, said bottom means including:

at least three parallel, horizontally aligned and laterally spaced conveyor belts each supported along its length by tubular support means having subatmospheric pressure therein, said tubular support means including perforated top portions across which perforated portions of said belts associated therewith are movable for directing said subatmospheric pressure to beneath portions of said blanks on top of said belts for firmly adhering said blanks to said belts during advancement of said blanks through said apparatus, said top folding means including rollers exerting pressure downwardly against the top surfaces of said blanks along the upstream end of said apparatus and a pair of laterally spaced folding staves extending downstream from said rollers about which said side panels are folded, said staves being substantially triangular in cross-section, each having side surfaces for engaging said side panels of said blanks that taper from a thick portion of said stave on the upstream end thereof to a thin portion on the downstream end thereof and having bottom surfaces for engaging the top surfaces of said blanks passing beneath said staves on top of said conveyor belts, said staves being hollow and having pressurized air therein, said side and bottom surfaces of said staves being perforated for directing said pressurized air against the portions of said blanks advancing adjacent such surfaces.

* * * * *